US009084295B2

(12) United States Patent
Sadakata et al.

(10) Patent No.: US 9,084,295 B2
(45) Date of Patent: Jul. 14, 2015

(54) ELECTROMAGNETIC COOKING DEVICE

(75) Inventors: Hideki Sadakata, Shiga (JP); Atsushi Fujita, Shiga (JP); Makoto Imai, Shiga (JP); Yuta Miura, Shiga (JP); Shinichiro Sumiyoshi, Osaka (JP)

(73) Assignee: Panasonic Corporation, Osaka (JP)

( * ) Notice: Subject to any disclaimer, the term of this patent is extended or adjusted under 35 U.S.C. 154(b) by 1099 days.

(21) Appl. No.: 13/119,908

(22) PCT Filed: Mar. 25, 2009

(86) PCT No.: PCT/JP2009/001310

§ 371 (c)(1),
(2), (4) Date: Mar. 18, 2011

(87) PCT Pub. No.: WO2010/089809

PCT Pub. Date: Aug. 12, 2010

(65) Prior Publication Data

US 2011/0168694 A1 Jul. 14, 2011

(30) Foreign Application Priority Data

Feb. 6, 2009 (JP) ..... 2009-025748

(51) Int. Cl.
*H05B 6/12* (2006.01)
*H05B 6/06* (2006.01)

(52) U.S. Cl.
CPC ..... *H05B 6/062* (2013.01); *H05B 2213/03* (2013.01)

(58) Field of Classification Search
CPC ..... H05B 2213/03; H05B 6/062
USPC ..... 219/620–626
See application file for complete search history.

(56) References Cited

U.S. PATENT DOCUMENTS 3,781,506 A * 12/1973 Ketchum et al. ..... 219/627
4,012,859 A * 3/1977 Johansson et al. ..... 42/75.03

(Continued)

FOREIGN PATENT DOCUMENTS

JP 58-128691 A 8/1983
JP 59-114789 A 7/1984

(Continued)

OTHER PUBLICATIONS

International Search Report for International Application No. PCT/JP2009/001310, dated Jun. 23, 2009, 2 pages.

(Continued)

*Primary Examiner* — Sang Y Paik
(74) *Attorney, Agent, or Firm* — Brinks Gilson & Lione

(57) ABSTRACT

An induction heating cooker includes a top plate adapted to have an object placed thereon, plural heating coils provided below a lower surface of the top plate, an inverter for supplying high-frequency power to the heating coils, a data memory, and a controller controlling the inverter. The data memory stores first and second heating coil patterns. Each of the first and second heating coil patterns defines one or more heatable regions and one or more non-heatable regions. The controller selects a heating coil pattern from the first and second coil patterns. The controller controls the inverter such that high-frequency power can be supplied to one or more first heating coils out of the plural heating coils located in the one or more heatable regions of the selected heating coil pattern. The controller controls the inverter such that high-frequency power cannot be supplied to one or more second heating coils out of the plural heating coils located in the one or more non-heatable regions of the selected heating coil pattern. This induction heating cooker can adjust at least one of the location, the size, and the number of the heatable regions for induction-heating objects in response to at least one of the location, the size, and the number of the objects to be heated, thereby heating the objects efficiently.

20 Claims, 13 Drawing Sheets

(56) References Cited

U.S. PATENT DOCUMENTS

| | | | | |
|---|---|---|---|---|
| 4,453,068 | A * | 6/1984 | Tucker et al. | 219/625 |
| 6,153,837 | A * | 11/2000 | Garcia et al. | 200/18 |
| 6,930,287 | B2 | 8/2005 | Gerola et al. | |
| 7,041,945 | B2 * | 5/2006 | Aihara et al. | 219/622 |
| 2005/0029245 | A1 | 2/2005 | Gerola et al. | |
| 2007/0164017 | A1 * | 7/2007 | Gouardo et al. | 219/626 |
| 2007/0262072 | A1 | 11/2007 | Schilling | |
| 2009/0008384 | A1 * | 1/2009 | Roux | 219/622 |
| 2010/0187217 | A1 | 7/2010 | Isoda et al. | |

FOREIGN PATENT DOCUMENTS

| | | | |
|---|---|---|---|
| JP | 61-191812 | A | 8/1986 |
| JP | 62-043092 | A | 2/1987 |
| JP | 05-047463 | A | 2/1993 |
| JP | 2003-142244 | A | 5/2003 |
| JP | 2004-031247 | A | 1/2004 |
| JP | 2004-135729 | A | 5/2004 |
| JP | 2004-192868 | A | 7/2004 |
| JP | 2007-026789 | A | 2/2007 |
| JP | 2008-527294 | A | 7/2008 |
| JP | 2008-293871 | A | 12/2008 |
| WO | WO 97/37515 | A1 | 10/1997 |
| WO | WO 2008/122495 | A1 | 10/2008 |
| WO | WO 2009/011130 | A1 | 1/2009 |

OTHER PUBLICATIONS

Extended European Search Report for European Application No. 09839588.2, dated Aug. 9, 2011, 5 pages.

* cited by examiner

ELECTROMAGNETIC COOKING DEVICE

This application is a 371 application of PCT/JP2009/001310 having an international filing date of Mar. 25, 2009, which claims priority to JP2009-025748 filed on Feb. 6, 2009, the entire contents of which are incorporated herein by reference.

TECHNICAL FIELD

The present invention relates to an induction heating cooker.

BACKGROUND ART

Patent Literature 1 discloses a conventional induction heating cooker including a heating coil having a spiral shape for heating an object. When the object is different in size from the heating coil, this conventional cooker incurs a lower heating efficiency due to increase in leakage magnetic flux or degradation in cooking performance since the heat is not distributed uniformly. This conventional induction heating cooker is thus obliged to restrict sizes of the objects.

Patent Literature 2 discloses another conventional induction heating cooker including a heating coil which can be energized partly. This cooker allows a user to select a heating area by activating a key for two objects different in size, so that the two objects can be heated efficiently. However, in the case that a small object is to be heated, a useless section of the heating coil is obliged to exist. Use of this heating coil in an induction heating cooker having multiple heating ports allows the cooker to heat different-sized objects; however, it is difficult to reserve a place for installing another heating coil, so that the heating coil can heat only a small object.

Patent Literature 1: JP2004-31247A

Patent Literature 2: JP05-47463A

SUMMARY OF THE INVENTION

An induction heating cooker includes a top plate adapted to have an object placed thereon, plural heating coils provided below a lower surface of the top plate, an inverter for supplying high-frequency power to the heating coils, a data memory, and a controller controlling the inverter. The data memory stores first and second heating coil patterns. Each of the first and second heating coil patterns defines one or more heatable regions and one or more non-heatable regions. The controller selects a heating coil pattern from the first and second coil patterns. The controller controls the inverter such that high-frequency power can be supplied to one or more first heating coils out of the plural heating coils located in the one or more heatable regions of the selected heating coil pattern. The controller controls the inverter such that high-frequency power cannot be supplied to one or more second heating coils out of the plural heating coils located in the one or more non-heatable regions of the selected heating coil pattern.

This induction heating cooker can adjust at least one of the location, the size, and the number of the heatable regions for induction-heating objects in response to at least one of the location, the size, and the number of the objects to be heated, thereby heating the objects efficiently.

DETAILED DESCRIPTION OF THE PREFERRED EMBODIMENT

Figure 1A:
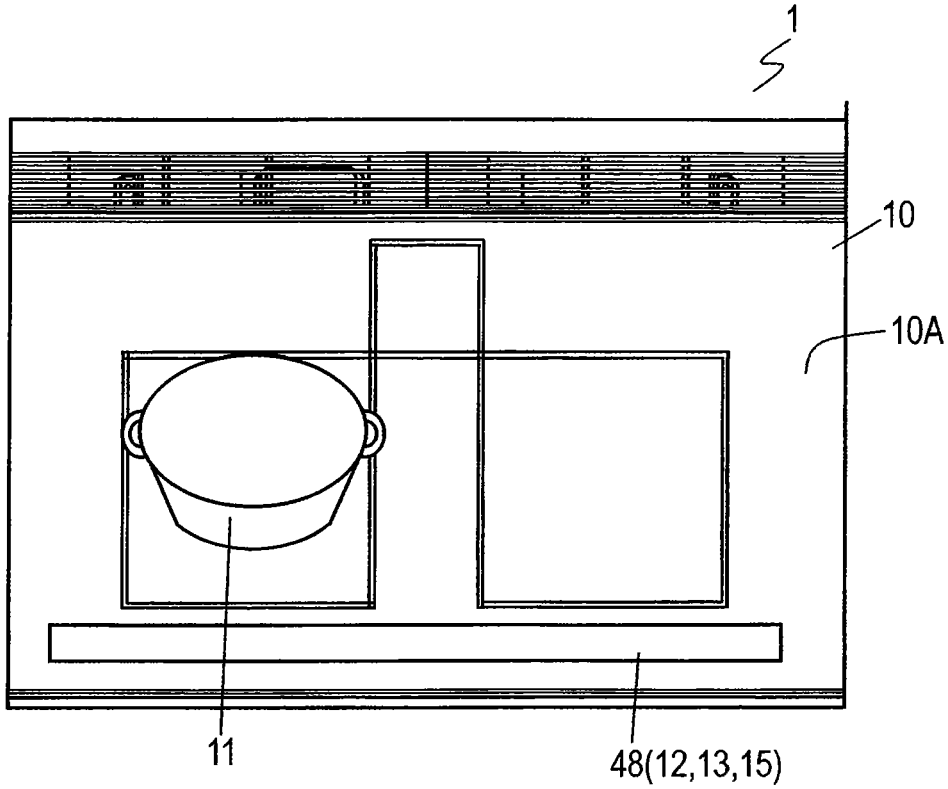
FIG. 1A is a top view of an induction heating cooker in accordance with an exemplary embodiment of the present invention.
Figure 1B:
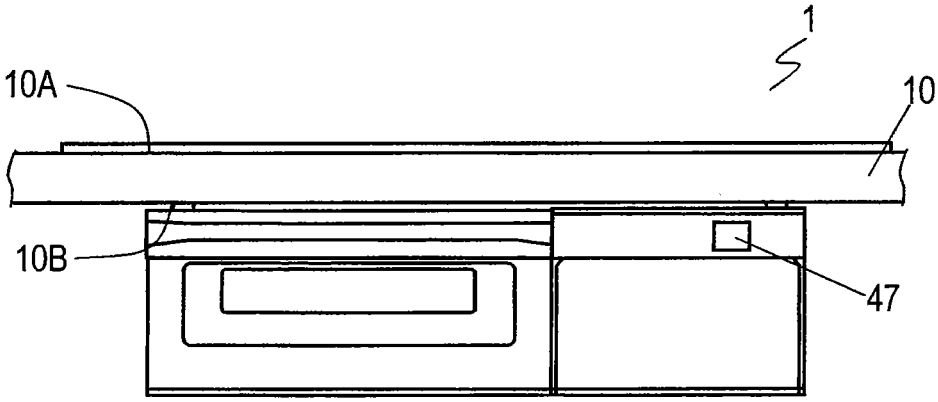
FIG. 1B is a side view of the induction heating cooker shown in FIG. 1A.
Figure 2:
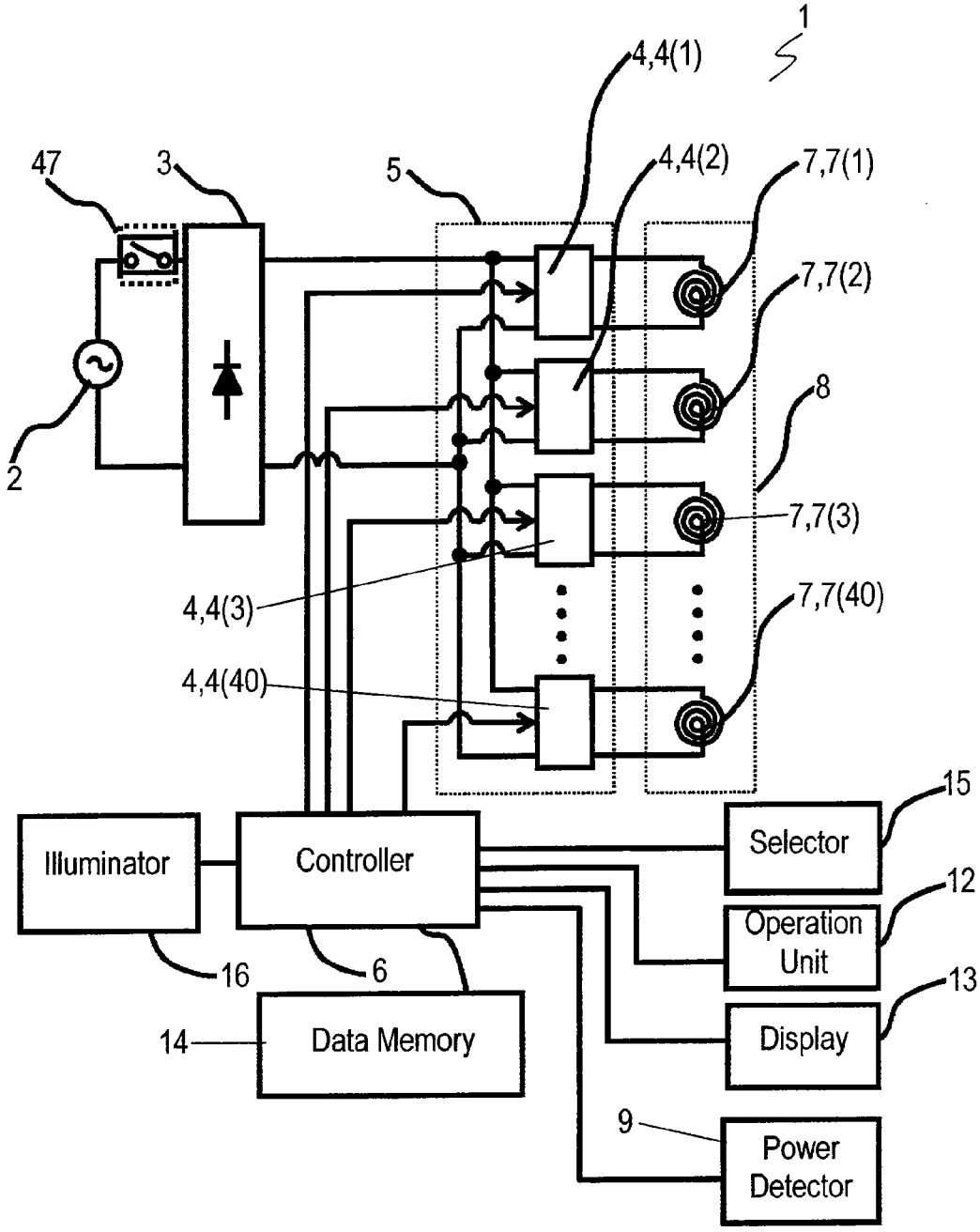
FIG. 2 is a circuit diagram of the induction heating cooker in accordance with the embodiment.

FIGS. 1A and 1B are a top view and a side view of induction heating cooker 1 in accordance with an exemplary embodiment of the present invention, respectively. FIG. 2 is a circuit diagram of induction heating cooker 1. Induction heating cooker 1 includes filter circuit 3, inverter 5, controller 6, heating coil section 8, power detector 9, top plate 10, operation panel 48, data memory 14, and main power switch 47. Filter circuit 3 converts an alternating-current (AC) power supplied from commercial power source 2 of 100V or 200V into a direct-current (DC) power. Inverter 5 including plural inverter circuits 4 each generating a high-frequency power of a predetermined frequency from the DC power supplied from filter circuit 3. Controller 6 is operable to drive and control inverter 5. Heating coil section 8 is formed of plural heating coils 7 for generating high-frequency magnetic flux from the high-frequency power. Power detector 9 detects the power supplied to heating coil section 8. Top plate 10 is placed above the heating coils 7. Operation panel 48 is operated by a user for controlling controller 6. Data memory 14 stores plural heating coil patterns. Main power switch 47 connects and disconnects between commercial power source 2 and filter circuit 3. Operation panel 48 includes heat-operation unit 12, display 13, and selector 15. A user operates heat-operation unit 12 to adjust the power or a temperature. Selector 15 selects one of the heating coil patterns stored in data memory 14. Main power switch 47 turns on or off the power supplied to inverter 5. Data memory 14 and controller 6 are implemented by a microprocessor. Filter circuit 3 includes a rectifying circuit and a power-factor improving circuit. Inverter circuit 4 includes a switching element for turning on and off, at a predetermined timing, the DC power converted by filter circuit 3. Top plate 10 is made of material, such as hard glass, having heat resistance and light transmittance. Top plate 10 has upper surface 10A and lower surface 10B opposite to upper surface 10A. Upper surface 10A is arranged to have object 11, such as a pot or a pan, placed thereon. Plural heating coils 7 are placed along and beneath lower surface 10B and substantially on a single plane.

A user operates heat-operation unit 12 for setting a high-frequency power supplied to coil section 8 or a temperature at which object 11 is heated. Display 13 displays the power or the temperature set by the user as well as progress of a menu, such as an automatic cooking menu. Each of the heating coil patterns is data for indicating heating coil 7 out of the plural heating coils to which high-frequency power is supplied and another heating coil 7 to which high-frequency power is not supplied. Each of the heating coil patterns determines the locations, the sizes, and the number of heatable regions on upper surface 10A of top plate 10.

Figure 3:
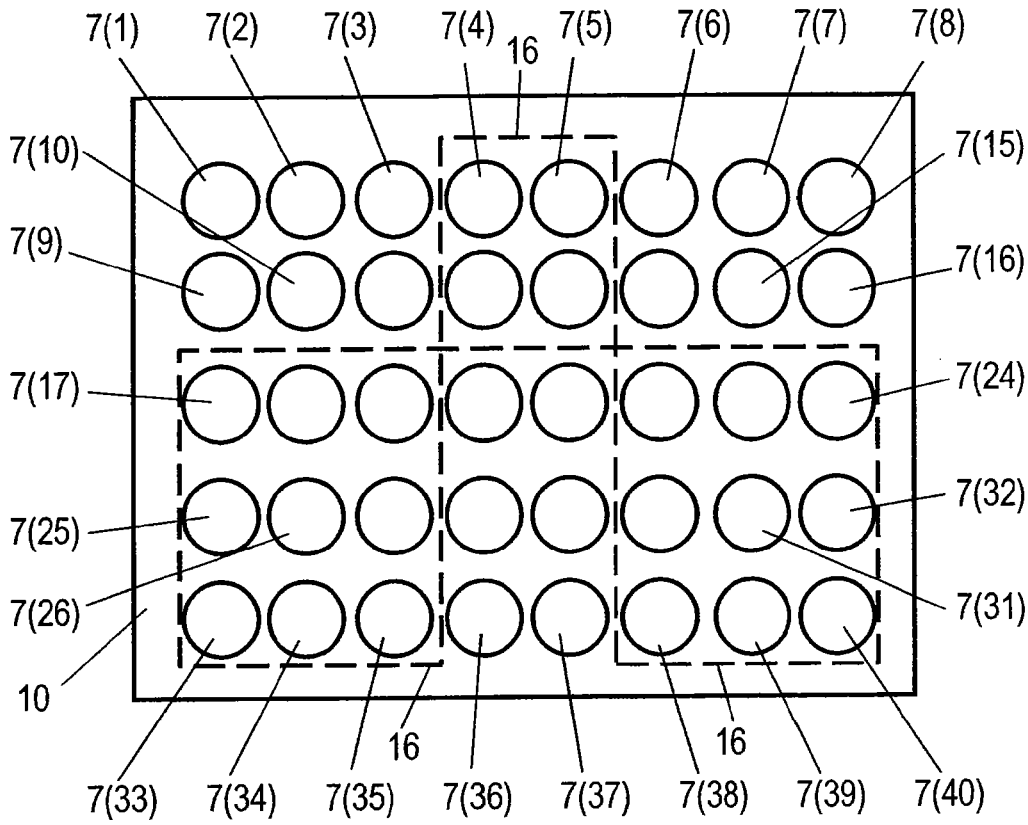
FIG. 3 is a top view of a top plate of the induction heating cooker in accordance with the embodiment.

FIG. 3 is a top view of top plate 10 and illustrates the arrangement of heating coils 7(1) to 7(40). Each of heating coils 7(1) to 7(40) has a spiral circular shape having a diameter of 70 mm. They are arranged in a matrix having 8 rows and 5 columns. Each of coils 7 is surrounded by illuminator 16 which emits light. Coil 7 may have another shape, such as a rectangular shape, an oval shape, or a polygonal shape. Coils 7 do not necessarily have shapes identical to each other. The number of coils 7 is not limited to 40, and coils 7 can be arranged in a shape other than the matrix.

FIGS. 4A to 4D show heating coil patterns PT1 to PT4 stored in data memory 4, respectively. Coil pattern PT1 shown in FIG. 4A defines groups 27A, 28A, 29A, and 51A. Each of the groups includes at least one of multiple heating coils 7. Coil pattern PT1 also defines heatable regions 27, 28, and 29 on upper surface 10A of top plate 10, and defines non-heatable regions 51 on upper surface 10A. Group 27A consists of some heating coils 7, i.e., coils 7(17) to 7(19), 7(25) to 7(27), and 7(33) to 7(35) out of plural heating coils 7. Group 28A consists of heating coils 7(22) to 7(24), 7(30) to 7(32), and 7(38) to 7(40). Group 29A consists of heating coils 7(4), 7(5), 7(12), and 7(13). Group 51A consists of heating coils 7(1) to 7(3), 7(6) to 7(8), 7(9) to 7(11), 7(14) to 7(16), 7(20), 7(21), 7(28), 7(29), 7(36), and 7(37).

Heating coils 7 belonging to group 27A are controlled by controller 6 such that high-frequency power is supplied to the coils, and thus, form heatable region 27 on upper surface 10A. Heating coils 7 belonging to group 28A are controlled by controller 6 such that high-frequency power can be supplied to the coils, and thus, form heatable region 28 on upper surface 10A. Heating coils 7 belonging to group 29A are controlled by controller 6 such that high-frequency power can be supplied to the coils, and thus, form heatable region 29 on upper surface 10A. Heating coils 7 belonging to group 51A can be controlled by controller 6 such that high-frequency power cannot be supplied to the coils, and thus, form non-heatable regions 51 on upper surface 10A.

Figure 4A:
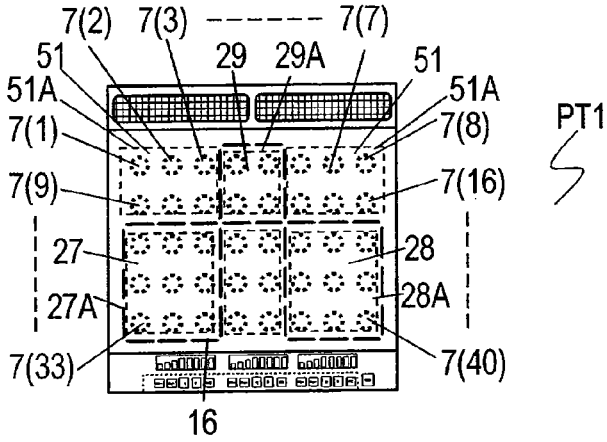
FIG. 4A is a top view of the induction heating cooker for illustrating a heating coil pattern stored in a data memory.
Figure 4B:
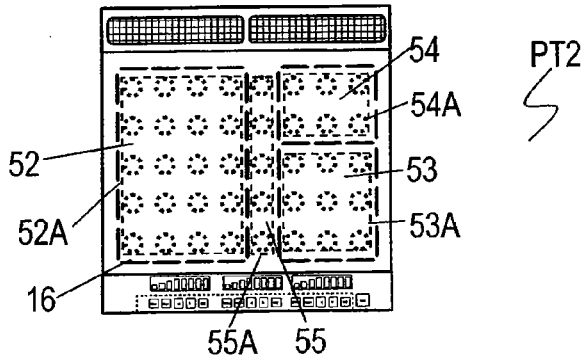
FIG. 4B is a top view of the induction heating cooker for illustrating another heating coil pattern stored in the data memory.

Heating coil pattern PT2 shown in FIG. 4B defines groups 52A, 53A, 54A, and 55A. Each of the groups includes at least one of plural heating coils 7. Coil pattern PT2 also defines heatable regions 52, 53, 54 and non-heatable region 55 on upper surface 10A of top plate 10. Group 52A consists of some heating coils 7, i.e., heating coils 7(1) to 7(4), 7(9) to 7(12), 7(17) to 7(20), 7(25) to 7(28), and 7(33) to 7(36) out of plural heating coils 7. Group 53A consists of heating coils 7(22) to 7(24), 7(30) to 7(32), and 7(38) to 7(40). Group 54A consists of heating coils 7(6) to 7(8) and 7(14) to 7(16). Group 55A consists of heating coils 7(5), 7(13), 7(21), 7(29), and 7(37).

Heating coils 7 belonging to group 52A are controlled by controller 6 such that high-frequency power can be supplied to the coils, and thus, form heatable region 52 on upper surface 10A. Heating coils 7 belonging to group 53A are controlled by controller 6 such that high-frequency power can be supplied to the coils, and thus, form heatable region 53 on upper surface 10A. Heating coils 7 belonging to group 54A are controlled by controller 6 such that high-frequency power can be supplied to the coils, and thus, form heatable region 54 on upper surface 10A. Heating coils 7 belonging to group 55A are controlled by controller 6 such that high-frequency power cannot be supplied to the coils, and thus, form non-heatable region 55 on upper surface 10A.

Figure 4C:
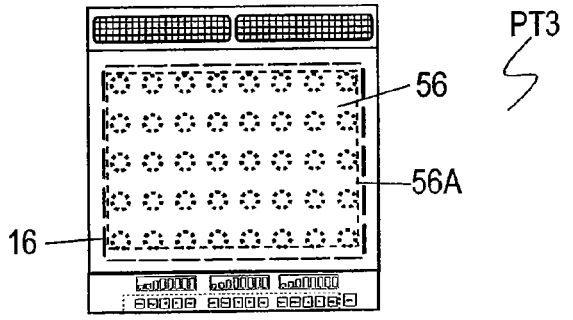
FIG. 4C is a top view of the induction heating cooker for illustrating still another heating coil pattern stored in the data memory.

Heating coil pattern PT3 shown in FIG. 4C defines group 56A consisting of all the plural heating coils 7 that are controlled by controller 6 such that high-frequency power can be supplied to the coils. Group 56A thus consists of heating coils 7(1) to 7(40). Pattern PT3 also defines heatable region 56 on upper surface 10A of top plate 10.

Figure 4D:
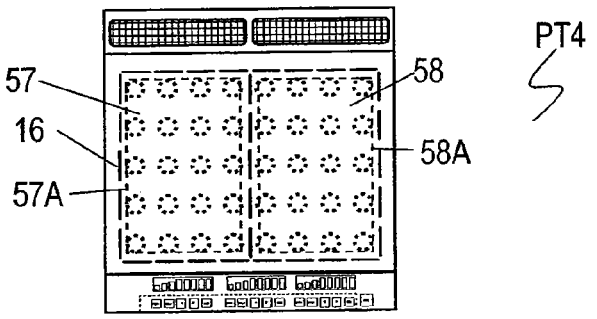
FIG. 4D shows a top view of the induction heating cooker for illustrating a further heating coil pattern stored in the data memory.

Heating coil pattern PT4 shown in FIG. 4D defines groups 57A and 58A. Groups 57A and 58A include at least one of plural heating coils 7, respectively. Pattern PT4 also defines heatable regions 57 and 58 on upper surface 10A. Group 57A consists of heating coils 7(1) to 7(4), 7(9) to 7(12), 7(17) to 7(20), 7(25) to 7(28), and 7(33) to 7(36). Group 58A consists of heating coils 7(5) to 7(8), 7(13) to 7(16), 7(21) to 7(24), 7(29) to 7(32), and 7(37) to 7(40). Heating coils 7 belonging to group 57A are controlled by controller 6 such that high-frequency power can be supplied to the coils, and thus, form heatable region 57 on upper surface 10A. Heating coils 7 belonging to group 58A are controlled by controller 6 such that high-frequency power can be supplied to the coils, and thus, form heatable region 58 on upper surface 10A.

Figure 5:
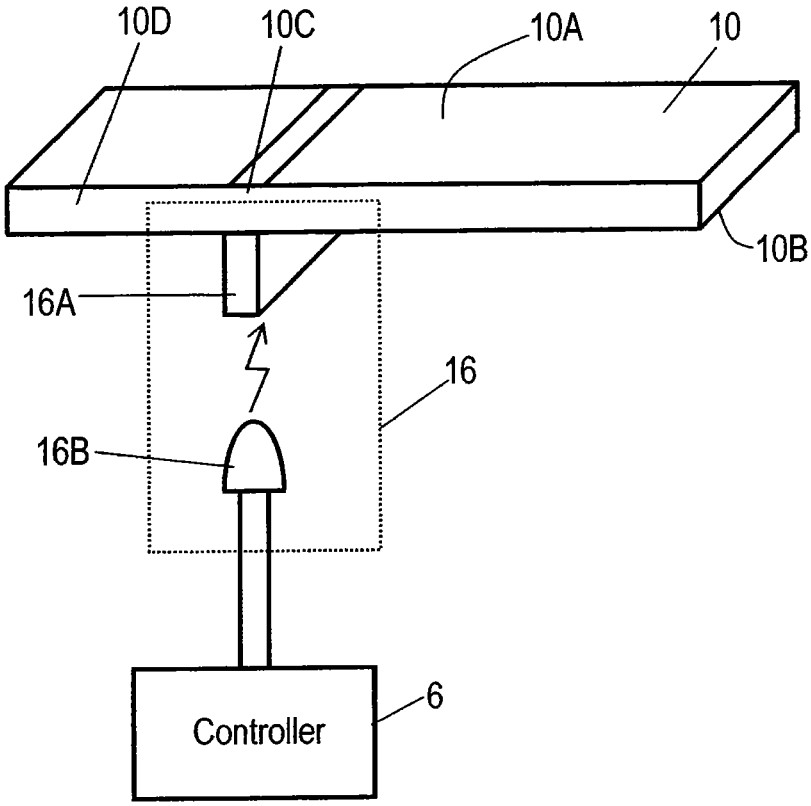
FIG. 5 is a schematic view of an illuminator of the induction heating cooker in accordance with the embodiment.

FIG. 5 is a schematic view of illuminator 16. Illuminator 16 includes light guide 16A and light emitter 16B for emitting light transmitting through top plate 10. Light guide 16A is placed beneath lower surface 10B of top plate 10. Light emitter 16B is implemented by a light-emitting element, such as an LED, a LASER, or a fluorescent lamp. Controller 6 controls light emitter 16B to have illuminator 16 out of the plural illuminators surrounding a heatable region emit light. This heatable region is formed based on the heating coil pattern selected by a user through selector 15. The user thus can visibly recognize the outline of the heatable region through upper surface 10A of top plate 10. The user thus can heat objects 11 with induction heating cooker 1 efficiently by adjusting the sizes, the location, and the number of the heatable regions in response to the sizes, the locations, and the number of objects 11.

Figure 6:
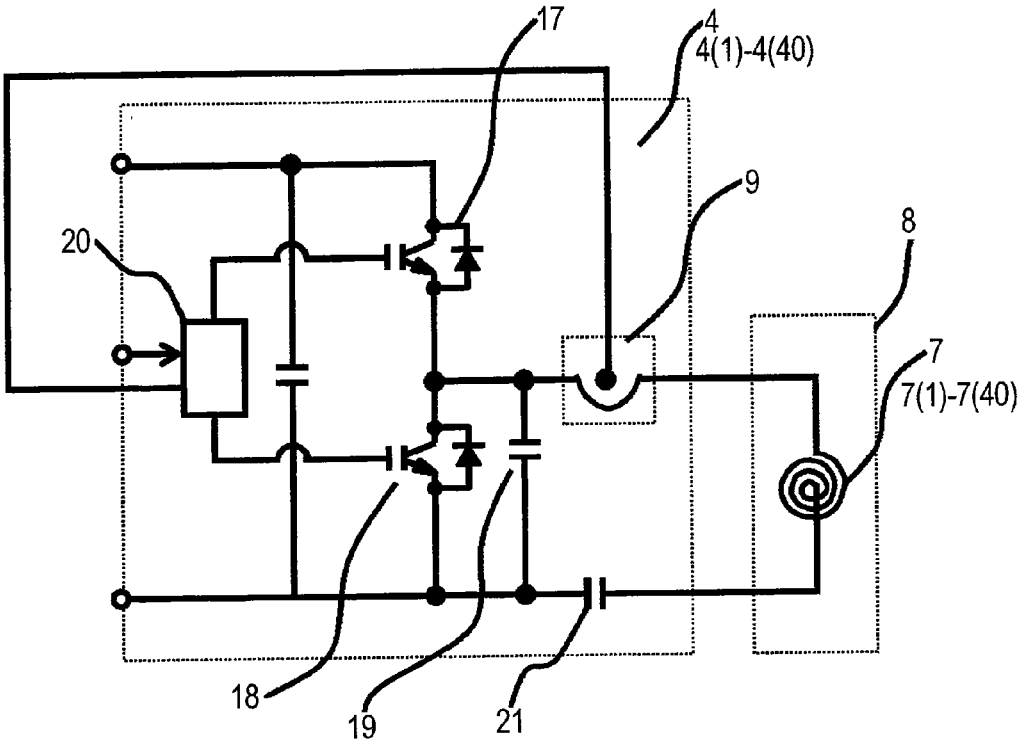
FIG. 6 is a circuit diagram of an inverter of the induction heating cooker in accordance with the embodiment.

FIG. 6 is a circuit diagram of inverter circuit 4. Inverter circuit 4 is provided to each of plural heating coils 7. Inverter circuit 4 includes switching elements 17 and 18, snubber capacitor 19 that reduces switching loss of switching elements 17 and 18, power detector 9 for detecting the power to be supplied to heating coils 7, conducting-duty adjuster 20, and resonant capacitor 21. Conducting-ratio adjuster 20 adjusts a duty to turn on each of switching elements 17 and 18.

Conducting-duty adjuster 20 sets a conducting duty for switching elements 17 and 18 based on the power detected sensed by power detector 9 and a signal supplied from controller 6. In response to the user's operation onto heat-operation unit 12, controller 6 supplies, to conducting-duty adjuster 20 for setting the power, a heat power signal, a heat starting signal, and a heat stopping signal. Comparing the power set by the heat power signal to the power detected by power detector 9, conducting-duty adjuster 20 sets the conducting duty of each of switching elements 17 and 18, thereby controlling the power supplied to heating coils 7.

Induction heating cooker 1 in accordance with this embodiment includes sole filter circuit 3 to supply the DC power to plural inverter circuits 4 to allow induction heating cooker 1 to include a smaller number of components, accordingly providing induction heating cooker 1 with a small size and a low manufacturing cost. Induction heating cooker 1 includes one inverter circuit 4 for each of plural heating coils 7, so that the high-frequency power can be supplied to plural heating coils 7. Inverter circuit 4 according to this embodiment is a single-ended and push-pull type; however, it can be another type, e.g. bridge type. Induction heating cooker 1 can further include a booster circuit, a step-down circuit or a step-up/down circuit which is connected between filter circuit 3 and inverter circuit 4.

Each of inverter circuits 4 supplies the power to each of heating coils 7, thereby controlling a heating amount generated by coil 7. To be more specific, plural inverter circuits 4, i.e., inverter circuits 4(1) to 4(40) supply power to heating coils 7(1) to 7(40), respectively, thereby controlling a heating amount generated by each of heating coils 7 independently. For instance, controller 6 sets different operating frequencies of inverter circuits 4(1) to 4(40) different from each other, and sets different conducting duties of switching elements 17 and 18 of the inverter circuits. This operation allows region 27 shown in FIG. 4A to heat a magnetic object, such as a pot or a pan made of iron, or magnetic stainless steel, and also allows region 28 to heat a nonmagnetic object, such as a pan or a pot made of non-magnetic stainless steel or aluminum.

Figure 7:
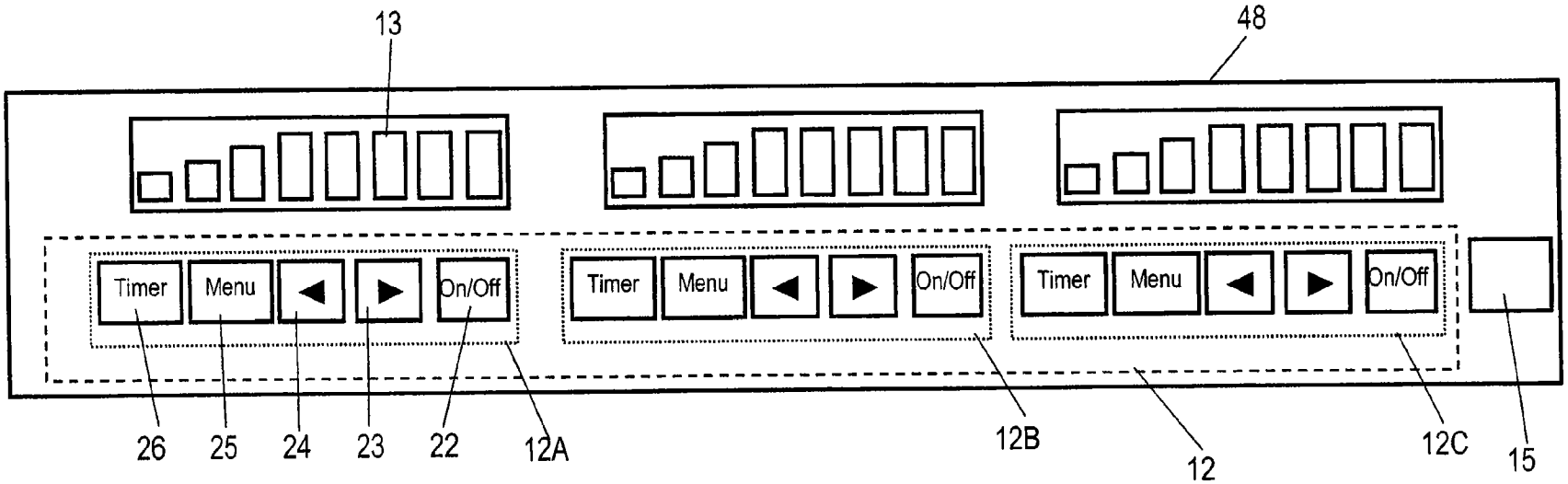
FIG. 7 is a schematic view of an operation panel of the induction heating cooker in accordance with the embodiment.

FIG. 7 is a schematic view of operation panel 48. Heat-operation unit 12 includes three heat-operation sections 12A to 12C for a user to operate three heatable regions, respectively. Each of heat-operation sections 12A to 12C includes heat-key 22, step-up key 23, step-down key 24, cooking menu key 25, and timer key 26. Each of these keys is formed of a switch, such as a touch key for sensing a capacitance, a push switch key, or a sound key. Selector 15 is placed at a position different from but near heat-operation unit 12.

An operation of induction heating cooker 1 will be described below. Controller. 6 sets heating coil pattern PT 1 shown in FIG. 4A as an initial pattern. A user turns on main power switch 47 for connecting commercial power source 2 to filter circuit 3. Controller 6 reads initial pattern PT1 from data memory 14, and controls inverter circuits 4 such that the high-frequency power can be supplied to heating coils 7 within heatable regions 27 to 29 of pattern PT1, and such that high-frequency power cannot be supplied to heating coils 7 within non-heatable regions 51. Controller 6 also controls light emitter 16B of illuminator 16 surrounding heatable regions 27 to 29 for emitting the light which surrounds regions 27 to 29 on top plate 10 so as to allow the user to visibly recognize that regions 27 to 29 are ready to heat objects.

Upon having an operation of selector 15 by the user, controller 6 reads one of coil patterns PT1 to PT4 from data memory 14 sequentially in a predetermined order, and controls inverter 5 such that the high-frequency power can be supplied to heating coils 7 within the heatable regions defined by the one of patterns PT1 to PT4. Further, controller 6 controls inverter 5 such that the high-frequency power cannot be supplied to multiple heating coils 7 within the non-heatable region. Controller 6 controls illuminator 16 such that the user can visibly recognize that the heatable regions on top plate 10 are ready to heat objects. As described above, the user selects a heating coil pattern with selector 15 for selecting an optimum pattern to a cooking menu while the user monitors the heatable regions displayed on top plate 10. To be more specific, the user can operate selector 15 to adjust the locations, the sizes and the number of the heatable regions from heatable regions 27 to 29 shown in FIG. 4A to heatable regions 52 to 54 shown in FIG. 4B. Then, the user can operate selector 15 to adjust the locations, the sizes and the number of heatable regions from heatable regions 52 to 54 shown in FIG. 4B to heatable region 56 shown in FIG. 4C. Then, the user can operate selector 15 to adjust the locations, the sizes and the number of heatable regions from heatable region 56 shown in FIG. 4C to heatable regions 57 and 58 shown in FIG. 4D. Then the user can operate selector 15 to adjust the locations, the sizes and the number of heatable regions from heatable regions 57 and 58 to heatable regions 27 to 29 shown in FIG. 4A.

Data memory 14 stores heating coil patterns PT1, PT2, PT3, and PT4. Heating coil pattern PT1 defines one or more heatable regions 27, 28, and 29 and one or more non-heatable regions 51 on upper surface 10A of top plate 10. Heating coil pattern PT2 defines one or more heatable regions 52, 53, and 54 and one non-heatable region 55 on upper surface 10A. Heating coil pattern PT3 defines one heatable region 56 on upper surface 10A. Heating coil pattern PT4 defines one or more heatable regions 57 and 58 on upper surface 10A.

Controller 6 selects heating pattern PT1 out of heating patterns PT1, PT2, PT3, and PT4, and then, controls inverter 5 such that the high-frequency power can be supplied to heating coils 7 out of all the plural heating coils 7 located in one or more heatable regions 27, 28, and 29 of selected heating pattern PT1. Controller 6 further controls inverter 5 such that the high-frequency power cannot be supplied to heating coils 7 out of all the plural heating coils 7 located in one or more non-heatable region 51 of selected heating pattern PT1.

Similarly, controller 6 selects heating pattern PT2 out of heating patterns PT1, PT2, PT3, and PT4, and then, controls inverter 5 such that the high-frequency power can be supplied to heating coils 7 out of all the plural heating coils 7 located in one or more heatable regions 52, 53, and 54 of selected pattern PT2. Controller 6 further controls inverter 5 such that the high-frequency power cannot be supplied to heating coils 7 out of all the plural heating coils 7 located in one or more non-heatable region 55 of selected pattern PT2.

Similarly, controller 6 selects pattern PT3 out of heating patterns PT1, PT2, PT3, and PT4, and then, controls inverter 5 such that the high-frequency power can be supplied to heating coils 7 out of all the plural heating coils 7 located in one region 56 of selected pattern PT3.

Similarly, controller 6 selects pattern PT4 out of heating patterns PT1, PT2, PT3, and PT4, and then, controls inverter 5 such that the high-frequency power can be supplied to heating coils 7 out of all the plural heating coils located in one or more heatable regions 57 and 58 of selected pattern PT4.

The user operates heat-operation sections 12A to 12C to operate heating coils 7 belonging to groups 27A to 29A defining heatable regions 27 to 29 shown in FIG. 4A, respectively. In the case that object 11 is heated in region 27, the user starts heating by operating heat-operation section 12A at heat key 22, and then, the user operates step-up key 23, step-down key 24, cooking menu key 25, and timer key 26 in response to the progress of cooking. In the case that object 11 is heated in region 28, the user starts heating by operating heat-operation section 12B at heat key 22, and then the user operates step-up key 23, step-down key 24, cooking menu key 25, and timer key 26 in response to the progress of cooking. In the case where object 11 is heated in region 29, the user starts heating by operating heat-operation section 12C at heat key 22, and then the user operates step-up key 23, step-down key 24, cooking menu key 25, and timer key 26 in response to the progress of cooking.

The user operates heat-operation sections 12A to 12C to operate heating coils 7 belonging to groups 52A to 54A defining heatable regions 52 to 54 shown in FIG. 4B, respectively. In the case that object 11 is heated in region 52, the user starts heating by operating heat-operation section 12A at heat key 22, and then, the user operates step-up key 23, step-down key 24, cooking menu key 25, and timer key 26 in response to the progress of cooking. In the case that object 11 is heated in region 54, the user starts heating by operating heat-operation section 12B at heat key 22, and then, the user operates step-up key 23, step-down key 24, cooking menu key 25, and timer key 26 in response to the progress of cooking. In a case where object 11 is heated in region 53, the user starts heating by operating heat-operation section 12C at heat key 22, and then the user operates step-up key 23, step-down key 24, cooking menu key 25, and timer key 26 in response to the progress of cooking.

The user operates one of heat-operation sections 12A to 12C to operate heating coils 7 belonging to group 56A defining heatable region 56 shown in FIG. 4C. In other words, all the heating coils are operated with one of heat-operation sections 12A to 12C. In the case that object 11 is heated in region 56, the user starts heating by operating the one of heat-operation sections 12A to 12C at heat key 22, and then, the user operates step-up key 23, step-down key 24, cooking menu key 25, and timer key 26 in response to the progress of cooking.

The user operates two of heat-operation sections 12A to 12C to operate heating coils 7 belonging to groups 57A and 58A defining heatable regions 57 and 58 shown in FIG. 4D. In the case that object 11 is heated in region 57, the user starts heating by operating one of the two of heat-operation sections 12A to 12C at heat key 22, and then, the user operates step-up key 23, step-down key 24, cooking menu key 25, and timer key 26 in response to the progress of cooking. In the case that object 11 is heated in region 58, the user starts heating by operating the other of the two of heat-operation sections 12A to 12C at heat key 22, and then, the user operates step-up key 23, step-down key 24, cooking menu key 25, and timer key 26 in response to the progress of cooking.

Thus, upon operating selector 15 and displaying a heatable region optimum to a cooking menu, the user places object 11, such as a pot or a pan, on the region displayed on upper surface 10A of top plate 10. The user then operates heat key 22 of heat-operation unit 12 so as to start heating object 11.

Controller 6 controls inverter 5 to start heating the nine heating coils 7 belonging to group 27A defining heatable region 27 shown in FIG. 4A substantially simultaneously, to adjust heating amounts substantially simultaneously, and to stop heating substantially simultaneously. Similarly, nine heating coils 7 and four heating coils 7 belonging to groups 28A and 29A defining heatable regions 28 and 29 start heating substantially simultaneously, adjust heating amounts substantially simultaneously, and stop heating substantially simultaneously.

Upon main power switch 47 being turned on, controller 6 reads heating coil pattern PT1 as an initial heating coil pattern from data memory 14. Alternatively, controller 6 may store the heating coil pattern used when switch 47 is turned off last time, and can be set the stored pattern as the initial heating coil pattern. Upon reading out initial pattern PT1, controller 6 controls inverter circuit 4 and heating coils 7 in response to the initial coil pattern. Thus, controller 6 can set a heating coil pattern including frequently-used heatable regions as the initial heating coil pattern. This operation allows the user to easily select a heating coil pattern, hence allowing induction heating cooker 1 to be more convenient for the user.

Figure 8:
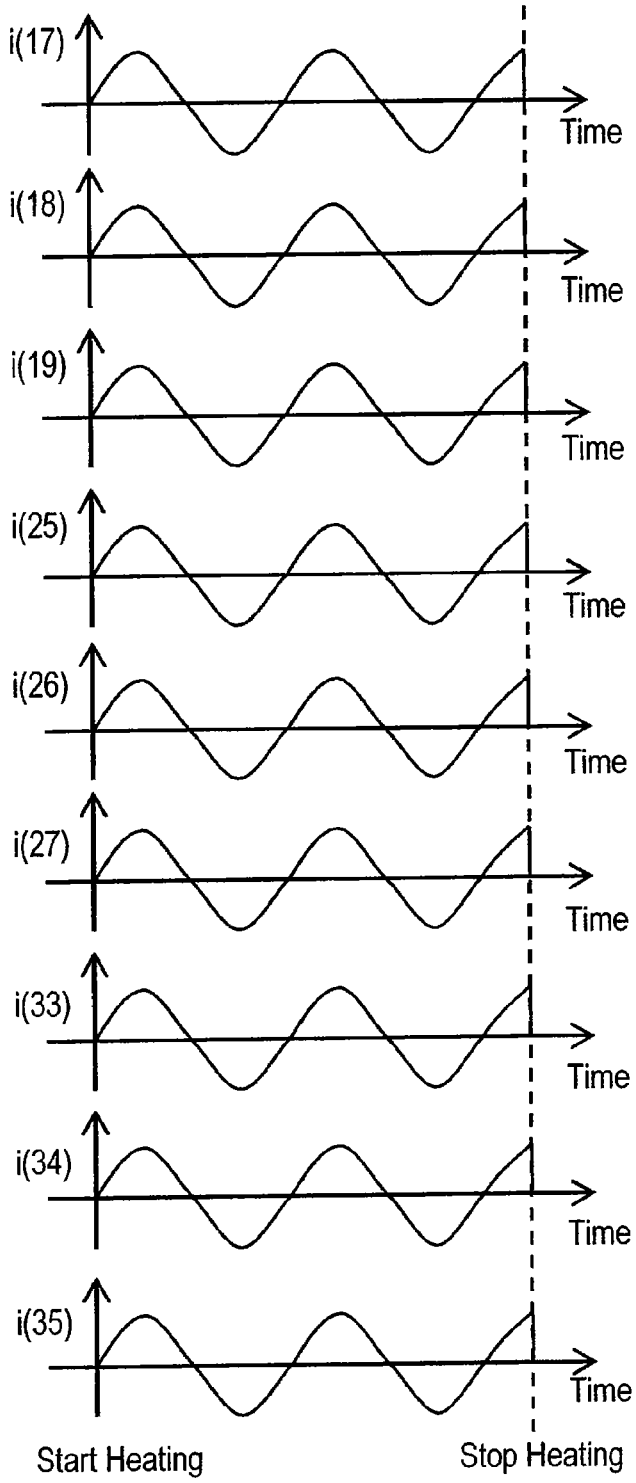
FIG. 8 shows waveforms of currents flowing in heating coils placed in a heatable region of the induction heating cooker in accordance with the embodiment.

FIG. 8 shows waveforms of currents i(17) to i(19), i(25) to i(27), and i(33) to i(35) flowing in heating coils 7(17) to 7(19), 7(25) to 7(27), and 7(33) to 7(35), respectively, belonging to group 27A in heatable region 27 when the user places a pot made of iron as object 11 in heatable region 27 then heats the pot and then stops the heating.

Figure 9:
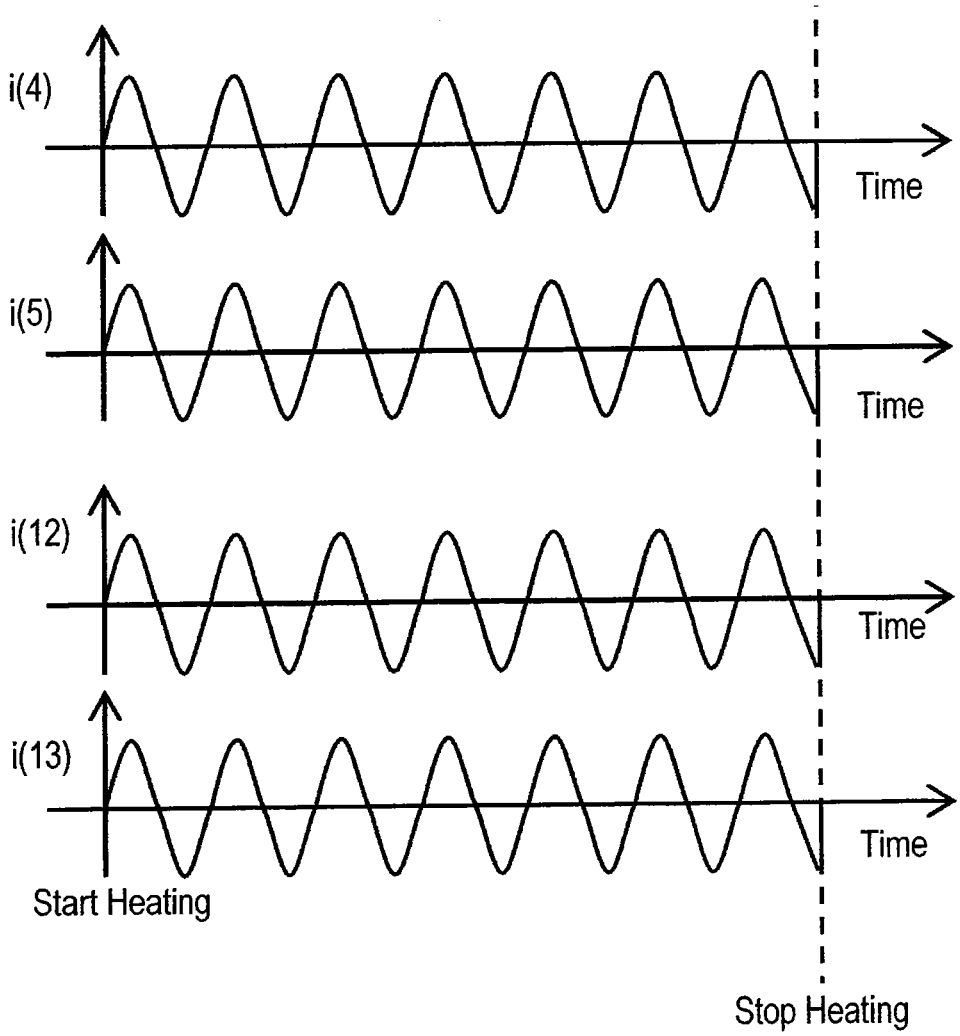
FIG. 9 shows waveforms of currents flowing in heating coils placed in another heatable region of the induction heating cooker in accordance with the embodiment.

FIG. 9 shows waveforms of currents i(4), i(5), i(12), and i(13) flowing in heating coils 7(4), 7(5), 7(12), and 7(13), respectively, belonging to group 29A in heatable region 29 when the user places a pot made of aluminum as object 11 in heatable region 29 then heats the pot and then stops heating.

As shown in FIG. 8, inverter 5 including inverter circuits 4 supplies electric currents having frequencies identical to each other and phases identical to each other to plural heating coils 7 located in heatable region 27. Inverter 5 starts supplying the currents substantially simultaneously to plural heating coils 7 located in heatable region 27, and stops supplying the currents substantially simultaneously.

As shown in FIG. 9, inverter 5 supplies electric currents having frequencies identical to each other and phases identical to each other to heating coils 7 located in heatable region 29. Inverter 5 starts supplying the currents substantially simultaneously, and stops supplying the currents substantially simultaneously.

In response to the operation to heat-operation unit 12 by the user, and in response to the material and the shape of object 11, controller 6 controls inverter 5 to determine the frequency, supply starting time, and supply stopping time of the electric currents flowing in heating coils 7 in heatable region 27 and to determine the frequency, supply starting time, and supply stopping time of the electric currents flowing in heating coils 7 in heatable region 29 independently from heatable region 27.

Similarly, controller 6 can supply electric currents to heating coils 7 forming group 28A in heatable region 28 shown in FIG. 4A, to heating coils 7 forming group 52A in heatable region 52, to heating coils 7 forming group 53A in heatable region 53, to heating coils 7 forming group 54A in heatable region 54 shown in FIG. 4B, and to heating coils 7 forming group 57A in heatable region 57, to heating coils 7 forming group 58A in heatable region 58 shown in FIG. 4D.

As discussed above, inverter 5 starts supplying electric currents to plural heating coils 7 located in one heatable region substantially simultaneously, and stops supplying the currents substantially simultaneously when the user stops heating.

In response to the operation of heat-operation unit 12 by the user, and in response to the material and the shape of object 11, controller 6 controls inverter 5 such that the frequency, supply a starting time, and a supply stopping time of the electric currents flowing in heating coils 7 in one heatable region can be set independently of those items of the electric current flowing in heating coils 7 in another heatable region. The user may not necessarily operate plural heating coils 7 independently, thus reducing the number of operations of induction heating cooker 1.

High-frequency power cannot be supplied to plural heating coils 7 located in non-heatable regions 51 and 55 shown in FIGS. 4A and 4B, so that metallic items, such as pots not to be heated, lids, or knives, can be placed in non-heatable regions 51 and 55. Since illuminator 16 allows the user to visibly recognize the heatable regions by surrounding those regions with light, the user also can visibly recognize distinctly the place where the metallic items not to be heated can be placed, hence providing induction heating cooker 1 with usability and safety.

While inverter circuit 4 supplies an electric current to heating coil 7 in at least one of the heatable regions, controller 6 disables selector 15 to operate even if the user operates selector 15 so as to prevent the heating coil patterns from changing. This operation avoids a non-safety situation, such as failing in cooking or heating an empty pot.

Induction heating cooker 1 in accordance with this embodiment allows controller 6 to control some heating coils to supply the high-frequency power, and to control other heating coils not to supply the high-frequency power, and the user can select a combination of these two types of heating coils with selector 15 and can adjust at least one of the locations, the sizes, and the number of the heatable regions.

The user adjusts at least one of the locations, the sizes, and the number of the heatable regions to heat desirable object 11 at a place convenient for the user, heating desirable object 11 at a place appropriate to the size of object 11, and heating desirable objects 11 in accordance with the number of objects 11.

The user adjusts at least one of the locations, sizes, and the number of the non-heatable regions. The user places a metallic item on the non-heatable region to prevent the metallic item from being heated against the user's intention, hence providing induction heating cooker 1 with usability and safety.

Heating coil pattern PT3 shown in FIG. 4C allows controller 6 to control inverter 5 such that high-frequency power can be supplied to all heating coils 7, hence forming a large heatable region occupying almost all the upper surface 10A of top plate 10. This structure can heat uniformly the bottom of object 11, such as a hot plate, requiring a large heating area, thus improving cooking performance of induction heating cooker 1.

Controller 6 may enable selector 6 to function along the user's operation for only a predetermined period of time after main power switch 47 is turned on, and then, disables selector 6 to function along the user's operation after the predetermined period of time elapses. This operation prevents the user from changing the heatable regions by an erroneous operation during the heating. This operation prevents a metallic item not to be heated from being heated, hence providing induction heating cooker 1 with usability and safety.

Figure 10:
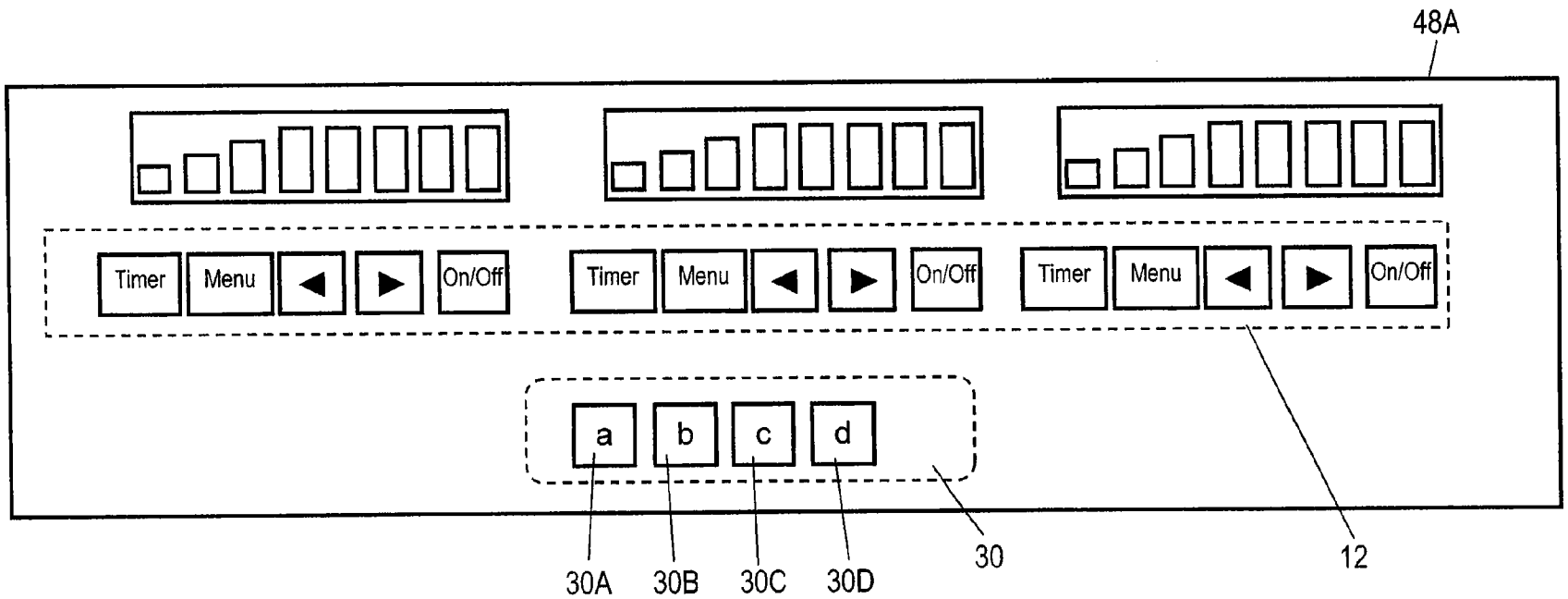
FIG. 10 is a schematic view of another operation panel of the induction heating cooker in accordance with the embodiment.

FIG. 10 is a schematic view of another operation panel 48A of induction heating cooker 1 in accordance with the embodiment. In FIG. 10, components identical to those of operation panel 48 shown in FIG. 7 are denoted by the same reference numerals, and their description will be omitted. Operation panel 48A shown in FIG. 10 includes selecting unit 30 formed of plural selectors 30A to 30D instead of selector 15 of operation panel 48 shown in FIG. 7. In operation panel 48 in FIG. 7, upon selector 15 being operated by the user, controller 6 reads the heating coil patterns from data memory 14 in a predetermined order to change the heatable regions and the non-heatable regions. On the other hand, in operation panel 48A shown in FIG. 10, data memory 14 stores the relations between selectors 30A to 30D and heating coil patterns PT1 to PT4.

Upon the user operating selector 30A, controller 6 reads coil pattern PT1 corresponding to selector 30A from data memory 14, and then forms heatable regions 27 to 29 and non-heatable regions 51 shown in FIG. 4A. Upon the user operating selector 30B, controller 6 reads coil pattern PT2 corresponding to selector 30B from data memory 14, and then forms heatable regions 52 to 54 and non-heatable regions 55 shown in FIG. 4B. Upon the user operating selector 30C, controller 6 reads coil pattern PT3 corresponding to selector 30C from data memory 14, and then forms heatable region 56 shown in FIG. 4C. Upon the user operating selector 30D, controller 6 reads coil pattern PT4 corresponding to selector 30D from data memory 14, and then forms heatable regions 57 and 58 shown in FIG. 4D.

As discussed above, upon the user operating one of selectors 30A to 30D, controller 6 reads one of the heating coil patterns corresponding to the operated selector from data memory 14, and then forms heatable regions and non-heatable regions based on the heating coil pattern read out from data memory 14. Thus, the user can operate selectors 30A to 30D for selecting heating coil patterns PT1 to PT4 directly, and thus, can select directly at least one of the locations, the sizes, and the number of the heating coil patterns, hence reducing the number of operations on operation panel 48, and providing induction heating cooker 1 with usability.

Figure 11:
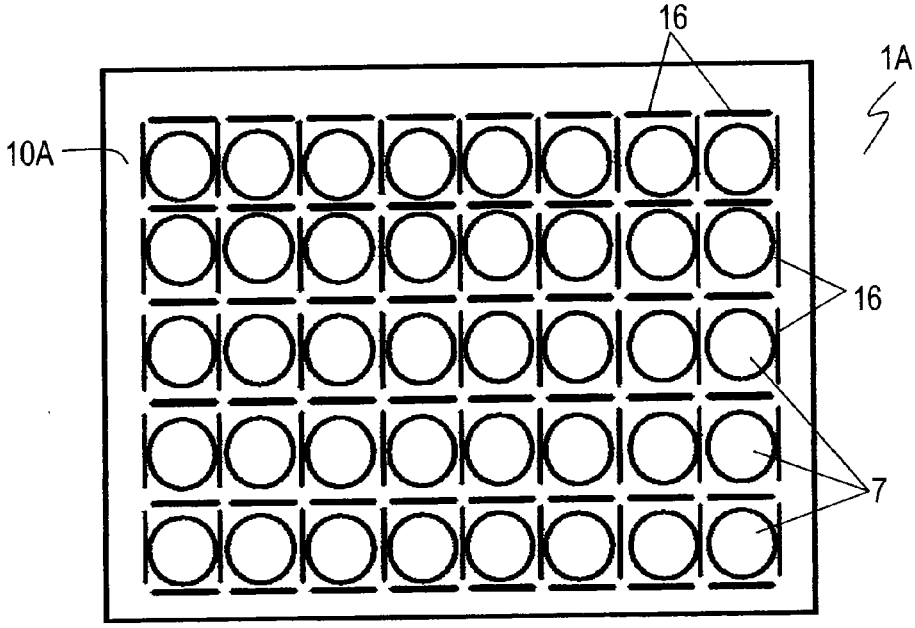
FIG. 11 shows a top view of another induction heating cooker in accordance with the embodiment.

FIG. 11 is a top view of another induction heating cooker 1A in accordance with the embodiment. In FIG. 11, components identical to those of induction heating cooker 1 shown in FIG. 3 are denoted by the same reference numerals, and their description will be omitted. Illuminator 16 of induction heating cooker 1 shown in FIG. 3 is located only at positions surrounding heatable regions 27 to 29, 52 to 54, and 56 to 58 shown in FIGS. 4A to 4D, and is not located at other positions. On the other hand, in induction heating cooker 1A shown in FIG. 11, illuminators 16 are located at positions surrounding each one of heating coils 7, so that a large number of heating coil patterns can be stored in data memory 14, and a large greater number of locations, sizes, and quantity of the heatable regions on top plate 10 can be selected by the users, hence providing induction heating cooker 1A with usability.

Figure 12:
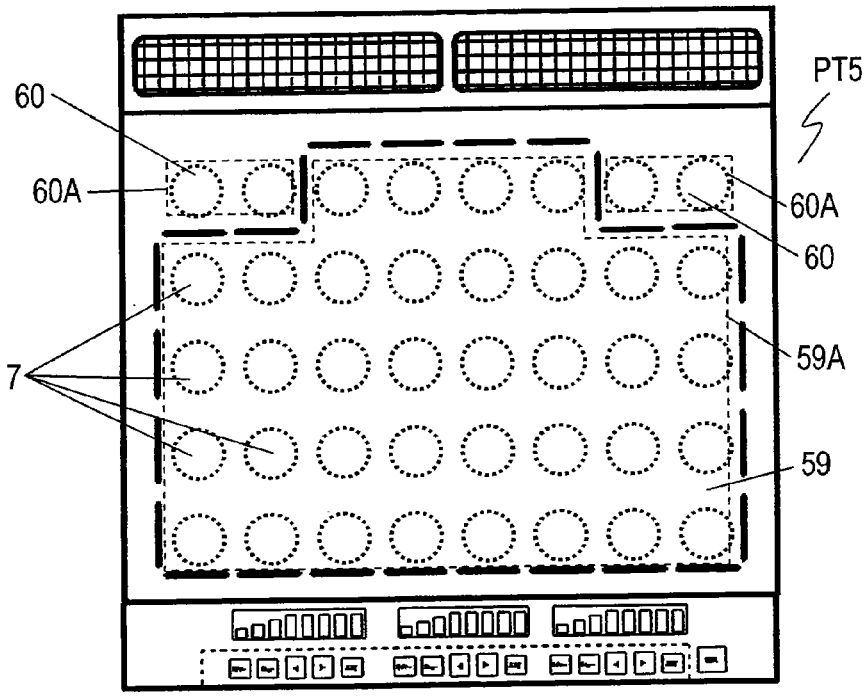
FIG. 12 shows a top view of a further heating coil pattern stored in the data memory.

FIG. 12 shows another heating coil pattern PT5 in addition to patterns PT1 to PT4 to be stored in data memory 14 of induction heating cooker 1A in accordance with the embodiment. In FIG. 12, components identical similar to those of heating coil pattern PT3 shown in FIG. 4C are denoted by the same reference numerals, and their description will by omitted. Pattern PT3 shown in FIG. 4C defines group 56A consisting of all the heating coils 7(1) to 7(40), so that single large heatable region 56 is formed on upper surface 10A of top plate 10. On the other hand, pattern PT5 defines group 59A consisting of heating coils 7(3) to 7(6) and 7(9) to 7(40) which are controlled by inverter 5 that can supply high-frequency power to the coils. Pattern PT5 also defines groups 60A consisting of heating coils 7(1), 7(2), 7(7), and 7(8) which are controlled by inverter 5 that cannot supply high-frequency power to the coils. Pattern PT5 thus defines heatable region 59 and non-heatable regions 60 on upper surface 10A of top plate 10.

Group 59A consisting of heating coils 7 forms large heatable region 59, and groups 60A consisting of heating coils 7 forms non-heatable regions 60. Heating coil pattern PT5 thus defines a large heatable region 59 which can execute a hot plate cooking that requires a large heating area because the bottom plate of an object can be heated uniformly. As a result, induction heating cooker 1 can improve its cooking performance. Further, the foregoing structure allows the user to place metallic items, such as pots, lids, or knives, not to be heated in non-heatable region 60 on upper surface 10A of top plate 10. The foregoing structure thus improves the usability of induction heating cooker 1, and prevents the metallic items from being heated against the user's intention.

Figure 13:
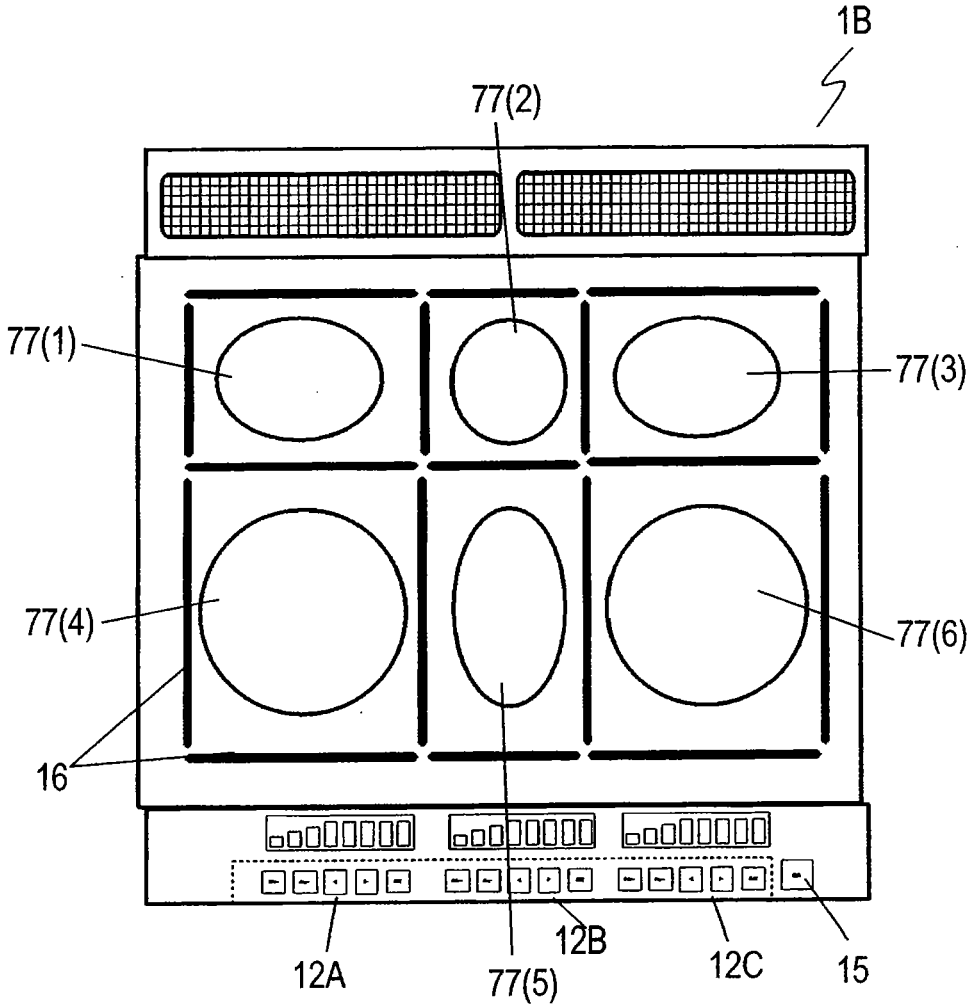
FIG. 13 shows a top view of still another induction heating cooker in accordance with the embodiment.

FIG. 13 is a top view of another induction heating cooker 1B in accordance with the embodiment. In FIG. 13, components identical to those of induction heating cooker 1 shown in FIGS. 3 and 4A to 4D are denoted by the same reference numerals, and their description will be omitted. Induction heating cooker 1B includes six heating coils 77(1) to 77(6) instead of forty heating coils 7(1) to 7(40) of induction heating cooker 1 shown in FIG. 3.

FIGS. 14A to 14D illustrate heating coil patterns PT11 to PT14 stored in data memory 14, respectively. Coil pattern PT11 shown in FIG. 14A defines groups 101A to 104A each consisting of at least one of heating coils 77(1) to 77(6), and defines heatable regions 101, 102, and 103 and non-heatable regions 104 on upper surface 10A of top plate 10. Group 101A consists of heating coil 77(4). Group 102A consists of coil 77(6). Group 103A consists of coil 77(2). Groups 104A consists of coils 77(1), 77(3), and 77(5). Heating coils 77(4), 77(6), and 77(2) of groups 101A, 102A, and 103A are controlled by inverter 5 such that high-frequency power is supplied to form heatable regions 101, 102, and 103 on upper surface 10A of top plate 10, respectively. The coils belonging to groups 104A are controlled by inverter 5 such that high-frequency power cannot be supplied to form non-heatable region 104 on upper surface 10A.

Figure 14A:
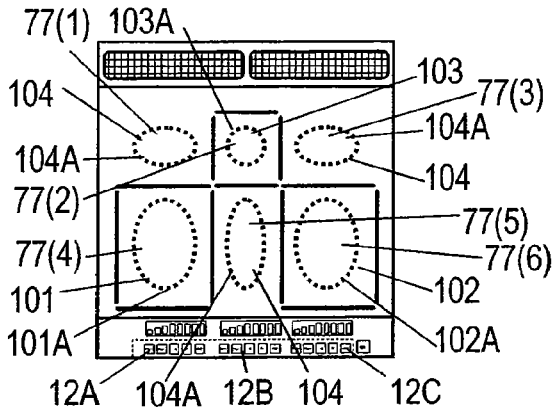
FIG. 14A shows a top view of a heating coil pattern of the induction heating cooker shown in FIG. 13.
Figure 14B:
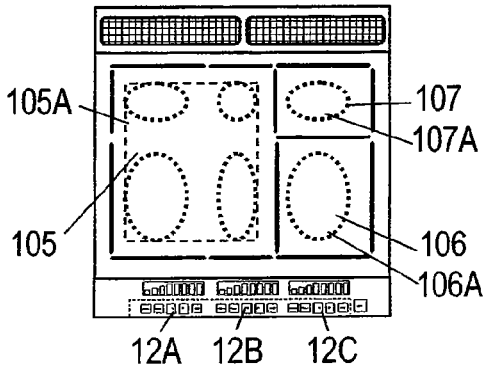
FIG. 14B shows a top view of a heating coil pattern of the induction heating cooker shown in FIG. 13.
Figure 14C:
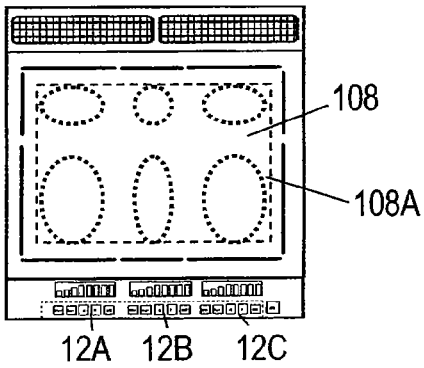
FIG. 14C shows a top view of a heating coil pattern of the induction heating cooker shown in FIG. 13.
Figure 14D:
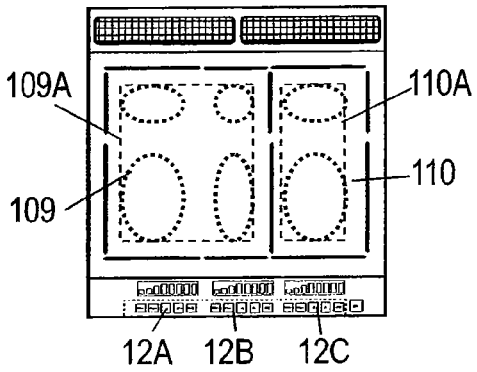
FIG. 14D shows a top view of a heating coil pattern of the induction heating cooker shown in FIG. 13.

Coil pattern PT12 shown in FIG. 14B defines groups 105A to 107A each consisting of at least one of heating coils 77(1) to 77(6), and defines heatable regions 105, 106, and 107. Group 105A consists of heating coils 77(1), 77(2), 77(4), and 77(5). Group 106A consists of coil 77(6). Group 107A consists of coil 77(3). The heating coils belonging to group 105A are controlled by inverter 5 such that high-frequency power can be supplied to form heatable region 105 on upper surface 10A of top plate 10. Coil 77(6) belonging to group 106A is controlled by inverter 5 such that high-frequency power can be supplied to form heatable region 106 on upper surface 10A. Coil 77(3) belonging to group 107A is controlled such that high-frequency power can be supplied so as to form heatable region 107 on upper surface 10A. Coil pattern PT13 shown in FIG. 14C defines group 108A consisting of all the heating coils 77(1) to 77(6), and defines heatable region 108 on upper surface 10A. The heating coils belonging to group 108A are controlled by inverter 5 such that high-frequency power can be supplied so as to form a large heatable region 108 to heat objects. Coil pattern PT14 shown in FIG. 14D defines group 109A consisting of heating coils 77(1), 77(2), 77(4), and 77(5), and group 110A consisting of coils 77(3) and 77(6). Pattern PT14 defines heatable regions 109 and 110 on upper surface 10A. The heating coils belonging to group 109A are controlled by inverter 5 such that high-frequency power is supplied so as to form heatable region 109 on upper surface 10A of top plate 10. The heating coils belonging to group 110A are controlled by inverter 5 such that high-frequency power can be supplied so as to form heatable region 110 on upper surface 10A.

Upon selector 15 of cooker 1B being operated by the user, controller 6 reads one of coil patterns PT11 to PT14 from data memory 14, similarly to induction heating cooker 1, and controls inverter 5 in response to the coil pattern read out from data memory 14 such that coils 77(1) to 77(6) form heatable regions 101 to 103, 105 to 110 and non-heatable regions 104. Upon heat switches 12A to 12D operated by the user, controller 6 to start heating, stop heating, and adjust an amount of heat supplied to the heatable regions 101 to 103 and 105 to 110. Induction heating cooker 1B shown in FIG. 13 includes a smaller number of heating coils 77 and inverter circuits 4 than induction heating cooker 1 shown in FIG. 3, thus having a smaller size and weight than induction heating cooker 1.

The foregoing embodiment does not limit the present invention.

INDUSTRIAL APPLICABILITY

An induction heating cooker according to the present invention can adjust at least one of the location, the size, and the number of the heatable regions for induction-heating objects in response to at least one of the location, the size, and the number of the objects to be heated, thereby heating the objects efficiently. This cooker can be used not only in ordinary homes, offices, but also in professional places, e.g. restaurants.

The invention claimed is:

1. An induction heating cooker comprising:

a top plate having an upper surface and a lower surface opposite to the upper surface, the upper surface being adapted to have an object placed thereon;

a plurality of heating coils distributed below the lower surface of the top plate for cooperative operation as a group to create any one of a plurality of heating coil patterns for the induction heating cooker;

an inverter to selectively supply high-frequency power to the plurality of heating coils in the group to create the any one of the plurality of heating coil patterns;

a data memory in which a first heating coil pattern and a second heating coil pattern are stored, the first heating coil pattern defining, by selective energization of all of the heating coils distributed below the lower surface of the top plate, one or more heatable regions and one or more non-heatable regions on the upper surface of the top plate, the second heating coil pattern defining by selective energization of all of the heating coils distributed below the lower surface of the top plate, one or more heatable regions and one or more non-heatable regions on the upper surface of the top plate, the first heating coil pattern being different from the second heating coil pattern based on the selective energization; and a controller operable to select only one heating coil pattern from the first heating coil pattern and the second coil pattern, control the inverter such that high-frequency power is supplied to one or more first heating coils in the group which are identified with the selected heating coil pattern as being in the one or more heatable regions of the selected heating coil pattern, and control the inverter such that high-frequency power cannot be supplied to one or more second heating coils in the group which are identified with the selected heating coil pattern as being in the one or more non-heatable regions of the selected heating coil pattern.

2. The induction heating cooker according to claim 1, wherein the controller is operable to control the inverter based on the selected heating coil pattern to adjust a location of the one or more heatable regions.

3. The induction heating cooker according to claim 1, wherein the controller controls the inverter based on the selected heating coil pattern to adjust a size of the one or more heatable regions.

4. The induction heating cooker according to claim 1, wherein the controller controls the inverter based on the selected heating coil pattern to adjust a number of the one or more heatable regions.

5. The induction heating cooker according to claim 1, wherein the controller controls the inverter based on the selected heating coil pattern to supply high-frequency power to the one or more first heating coils substantially simultaneously and to stop supplying the high-frequency power substantially simultaneously.

6. The induction heating cooker according to claim 1, wherein the data memory further stores a third heating coil pattern different from the first heating coil pattern and the second heating coil pattern, and the controller is operable to select a heating coil pattern from the first heating coil pattern, the second heating coil pattern, and the third heating coil pattern, and in a case that the controller selects the third heating coil pattern, the inverter to supply high-frequency power to all the plurality of heating coils to form one heatable region on the upper surface of the top plate for heating the object.

7. The induction heating cooker according to claim 6 further comprising:

a first selector connected to the controller;

a second selector connected to the controller; and a third selector connected to the controller, wherein the data memory stores a relation that the first selector, the second selector, and the third selector correspond to the first heating coil pattern, the second heating coil pattern, and the third heating coil pattern, respectively, and the controller is operable to select the first heating coil pattern upon the first selector operated by a user, select the second heating coil pattern upon the second selector operated by the user, and select the third heating coil pattern upon the third selector operated by the user.

8. The induction heating cooker according to claim 7, wherein the controller is operable to enable receipt from the first selector, the second selector, and the third selector of a signal indicative of an operation by the user while the inverter does not supply the high-frequency power, and disable receipt from the first selector, the second selector, and the third selector of a signal indicative of an operation by the user while the inverter supplies the high-frequency power.

9. The induction heating cooker according to claim 7, further comprising a main power switch for turning on and off power supplied to the inverter, wherein the controller is operable to enable receipt from the first selector, the second selector, and the third selector of a signal indicative of an operation by the user within a predetermined period of time after the main power switch is turned on to supply power to the inverter, and disable receipt from the first selector, the second selector, and the third selector of a signal indicative of an operation by the user after the predetermined period of time elapses.

10. The induction heating cooker according to claim 6, further comprising a selector connected to the controller, wherein upon the selector being operated by a user, the controller is operable to select a heating coil pattern sequentially from the first heating coil pattern, the second heating coil pattern, and the third heating coil pattern in a predetermined order.

11. The induction heating cooker according to claim 10, wherein the controller is operable to enable receipt from the selector of a signal indicative of an operation by the user while the inverter does not supply the high-frequency power, and disable receipt from the selector of a signal indicative of an operation by the user while the inverter supplies the high-frequency power.

12. The induction heating cooker according to claim 10, further comprising a main power switch for turning on and off power supplied to the inverter, wherein the controller is operable to enable receipt from the selector of a signal indicative of an operation by the user within a predetermined period of time after the main power switch is turned on to supply power to the inverter, and disable receipt from the selector of a signal indicative of an operation by the user after the predetermined period of time elapses.

13. The induction heating cooker according to claim 1 further comprising:

a first selector connected to the controller; and a second selector connected to the controller, wherein the data memory stores a relation that the first selector and the second selector correspond to the first heating coil pattern and the second heating coil pattern, respectively, and the controller is operable to select the first heating coil pattern upon the first selector being operated by a user, and select the second heating coil pattern upon the second selector being operated by the user.

14. The induction heating cooker according to claim 13, wherein the controller is operable to enable receipt from the first selector and the second selector of a signal indicative of operation by the user while the inverter does not supply the high-frequency power, and disable receipt from the first elector and the second selector of a signal indicative of an operation by the user while the inverter supplies the high-frequency power.

15. The induction heating cooker according to claim 13, further comprising a main power switch for turning on and off power supplied to the inverter, wherein the controller is operable to enable receipt from the first selector and the second selector of a signal indicative of an operation by the user within a predetermined period of time after the main power switch is turned on to supply power to the inverter, and disable receipt from the first selector and the second selector of a signal indicative of an operation by the user after the predetermined period of time elapses.

16. The induction heating cooker according to claim 1, further comprising a selector connected to the controller, wherein upon the selector being operated by a user, the controller is operable to select a heating coil pattern sequentially from the first heating coil pattern and the second heating coil pattern in a predetermined order.

17. The induction heating cooker according to claim 16, wherein the controller is operable to enable receipt from the selector of a signal indicative of an operation by the user while the inverter does not supply the high-frequency power, and disable receipt from the selector of a signal indicative of an operation by the user while the inverter supplies the high-frequency power.

18. The induction heating cooker according to claim 16, further comprising a main power switch for turning on and off power supplied to the inverter, wherein the controller is operable to enable receipt from the selector of a signal indicative of an operation by the user within a predetermined period of time after the main power switch is turned on to supply power to the inverter, and disable receipt from the selector of a signal indicative of an operation by the user after the predetermined period of time elapses.

19. The induction heating cooker according to claim 1, further comprising one or more illuminators surrounding each of the one or more heatable regions of the selected heating coil pattern for a user to visibly recognize the one or more heatable regions of the selected heating coil pattern on the upper surface of the top plate.

20. An induction heating cooker comprising:

a top plate having an upper surface and a lower surface opposite to the upper surface, the upper surface being adapted to have an object placed thereon;

a plurality of heating coils distributed below the lower surface of the top plate to form an entirety of the heating coils positioned below the lower surface;

an inverter to supply high-frequency power to the plurality of heating coils;

a data memory to store a first heating coil pattern and a second heating coil pattern, the first heating coil pattern defining, by selective energization of all the heating coils distributed below the lower surface of the top plate as being part of either one or more heated regions or one or more non-heated regions on the upper surface of the top plate, the second heating coil pattern defining, by selective energization of all the heating coils distributed below the lower surface of the top plate as being part of either one or more heated regions or one or more non-heated regions on the upper surface of the top plate, the first heating coil pattern being different than the second heating coil pattern based on the selective energization of all the heating coils; and a controller operable to select a heating coil pattern from the first heating coil pattern and the second coil pattern, control the inverter based on the selected heating coil pattern such that high-frequency power is supplied to one or more first heating coils out of the entirety of the heating coils, and control the inverter based on the selected heating coil pattern such that high-frequency power is not supplied to one or more second heating coils representative of a remainder of the entirety of the heating coils.

* * * * *

UNITED STATES PATENT AND TRADEMARK OFFICE

CERTIFICATE OF CORRECTION

PATENT NO. : 9,084,295 B2
APPLICATION NO. : 13/119908
DATED : July 14, 2015
INVENTOR(S) : Hideki Sadakata et al.

It is certified that error appears in the above-identified patent and that said Letters Patent is hereby corrected as shown below:

On the Title Page

Item (73) Assignee, delete "Panasonic Corporation" and insert -- Panasonic Intellectual Property Management Co., Ltd. --

Signed and Sealed this
Twenty-fourth Day of May, 2016

Michelle K. Lee

Michelle K. Lee
*Director of the United States Patent and Trademark Office*